United States Patent [19]

Pagano et al.

[11] 4,398,446

[45] Aug. 16, 1983

[54] ADJUSTABLE COMBAT VEHICLE ARMOR

[75] Inventors: Victor H. Pagano; William J. Seyfert, both of Oakland, Mich.

[73] Assignee: The United States of America as represented by the Secretary of the Army, Washington, D.C.

[21] Appl. No.: 168,934

[22] Filed: Jul. 14, 1980

[51] Int. Cl.[3] ..... F41H 7/04

[52] U.S. Cl. ..... 89/36 H

[58] Field of Search ..... 89/36 R, 36 A, 36 H, 89/36 Z; 109/49.5; 114/11, 12, 14; 5/451

[56] References Cited

U.S. PATENT DOCUMENTS

| | | | |
|---|---|---|---|
| 37,013 | 11/1862 | Stillman | 114/11 |
| 727,699 | 5/1903 | Schneider | 114/11 |
| 3,765,299 | 10/1973 | Pagano et al. | 89/36 H |

FOREIGN PATENT DOCUMENTS

| | | | |
|---|---|---|---|
| 203908 | 6/1959 | Austria | 89/36 A |
| 1743 | of 1877 | United Kingdom | 89/36 A |
| 1318145 | 5/1973 | United Kingdom | 89/36 H |

*Primary Examiner*—Stephen C. Bentley

*Attorney, Agent, or Firm*—Peter A. Taucher; John E. McRae; Robert P. Gibson

[57] ABSTRACT

Add-on armor for military vehicles to prevent premature vehicle obsolesce due to enemy threats arising after the date of vehicle manufacture. The vehicle is designed to accept detachable armor components or systems, thereby permitting armor replacement to meet new enemy threats.

2 Claims, 11 Drawing Figures

ADJUSTABLE COMBAT VEHICLE ARMOR

The invention described herein may be manufactured, used, and licensed by or for the Government for governmental purposes without payment to us of any royalty thereon.

BACKGROUND AND SUMMARY OF THE INVENTION

Under conventional practice a combat vehicle is maintained in the inventory of the army system for upwards of 20 years before becoming obsolete. During this 20 year interval, various improvements in antiballistic materials may be invented or discovered, as a response to development of improved weapons systems by the potential enemy country. Normal mode of thinking has not viewed armor design as a changeable quantity after initial vehicle manufacture, even though a new threat situation is likely to occur while the vehicle is in the inventory system, i.e. during the normal service life of the vehicle. The present invention is directed to a military vehicle design wherein the antiballistic properties of the vehicle can be altered or varied at any time. This aim is accomplished by building a basic vehicle with minimum intrinsic armor characteristics but sufficient structural strength to selectively accept the weight of different add-on armor systems responsive to a variety of enemy threats arising after the date of vehicle manufacture. Vehicle armor capabilities are continually updated without the enormous cost and time expenditure for redesigning, testing and building completely new vehicles.

THE DRAWINGS

Figure 1:
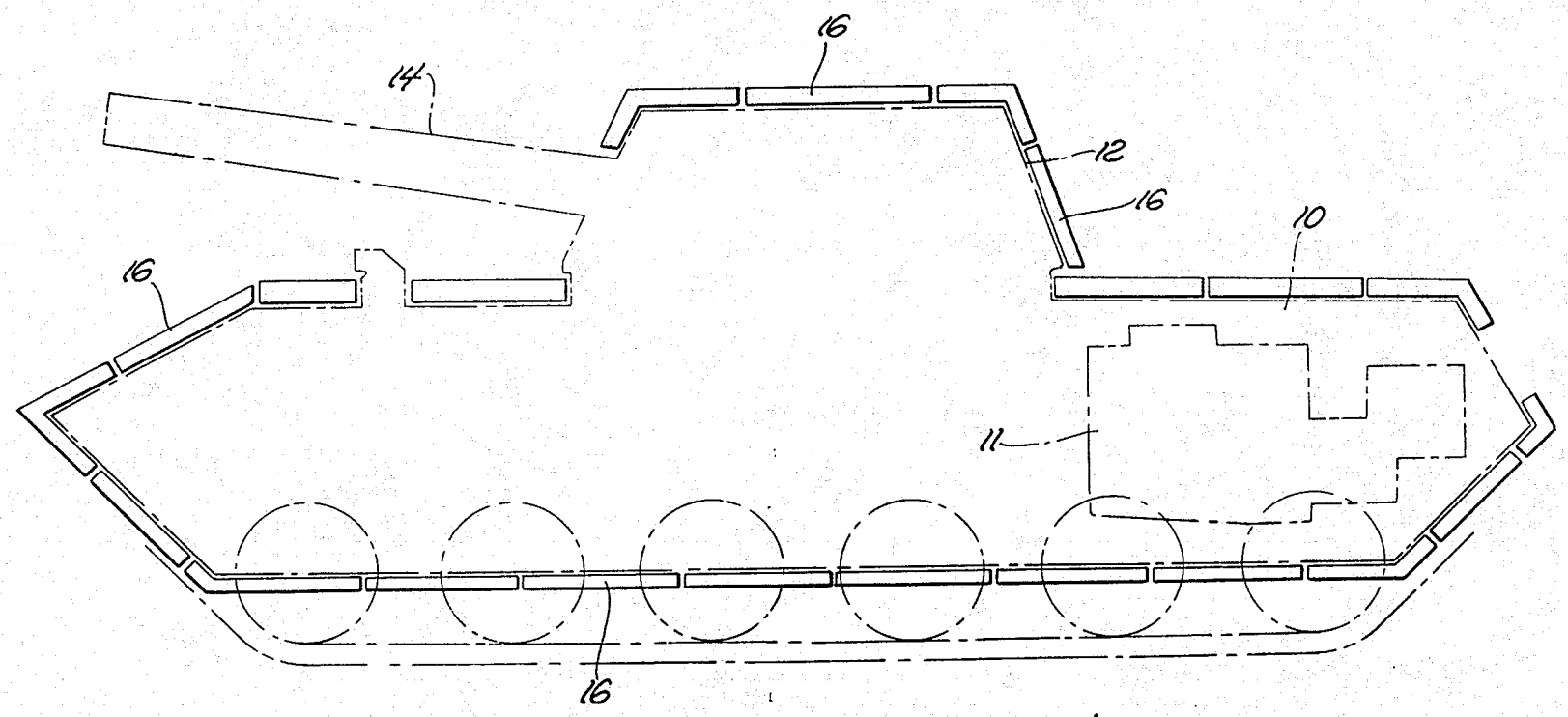

FIG. 1 is a sectional view taken through an armor system for a typical military vehicle adapted to utilize the present invention.

FIGS. 2 through 11 fragmentarily illustrate add-on armor components constructed according to the invention.

Our invention may be applied to various types of military vehicles, e.g. tanks, personnel carriers, armored cars, missile launchers, reconnaissance vehicles, ammunition carriers, fuel tankers or amphibious landing vehicles. For illustration purposes we show the invention applied to a tank. The vehicle may be of conventional design except for features necessary to accommodate detachable armor systems, as for example the following:

a. relatively thin vehicle walls, sufficient for structural integrity but not so thick as to impede vehicle mobility after addition of the armor.

b. relatively flat vehicle outer surfaces devoid of projections that might interfere with attachment of armor systems, and c. oversize power plant and suspension to handle the added weight of the armor system without significant adverse effect on vehicle mobility or stability.

Armor systems found on typical combat vehicles are the products of many interrelated and opposing factors to reach a reasonable balance between weight, mobility and protection. Past experience shows that a satisfactory armor system can comprise more than fifty percent of the total vehicle weight. Within the fifty weight percent constraint, future armor systems will probably have to meet a mixture of improved kinetic energy threats and non-kinetic energy threats involving some combination of the following:

a. intermediate caliber rapid-fire automatic weapons of approximately 30 mm armor piercing type, either high velocity or discarding sabot construction, b. larger caliber tank artillery or cannon of approximately 120 mm caliber, either armor-piercing, high explosive (fragmenting), or shaped charge warhead (HEAT) rounds.

c. Infantry-launched or vehicle-launched HEAT missiles, d. mines, and e. radiological threat The predicted mixture of enemy threats is continually subject to change, so that new equipment can face obsolescence even as early as initial production and introduction to the field.

With the system proposed under our invention, a basic vehicle is offered with ballistic protection against the minimum anticipated threat represented by anti-personnel weapons, such as small caliber projectiles, mortar fragments and anti-personnel land mines. The basic vehicle is up-armored through the use of various armor kits chosen to provide different levels of enhanced survivability. The vehicle suspension and propulsion systems are designed to handle the basic vehicle weight plus the anticipated weights of the add-on kits. Following are some of the contemplated add-on applique armor kits presently envisioned

| Threat | Add-on Armor Kit Options |
|---|---|
| armor piercing or HE projectiles | Monolithics, composite materials, spaced armor, ceramic armor, or explosive intercept armor. |
| HEAT rounds | spaced armor, bar armor, composite, or explosive intercept armor. |
| radiological | spaced, composite with borated polyethylene. |
| mines | composite materials or monolithics |

We envision that the add-on armor kits will, when used, provide the major anti-ballistic effect. For example, in a military tank having a total weight of fifty tons, we envision that the chassis plus the add-on armor will total as much as thirty tons; of this thirty tons approximately ten tons can be the bare chassis and twenty tons can be add-on armor. Assuming the surface area of the vehicle chassis to be on the order of five hundred square feet, a steel chassis would have an average wall thickness of one inch and an average areal density of 40 pounds per square foot of vehicle surface area. In this case, areal density multiplied by surface area totals 20,000 pounds, i.e. ten tons. The average areal density of the replaceable add-on armor will be 80 pounds per square foot; this figure is obtained by dividing total add-on armor weight by vehicle surface area. Assuming steel is the add-on armor material, the average wall thickness will be two inches. Replacement of the add-on armor with armor formed of lighter or ballistically superior materials invented or conceived after initial date of vehicle manufacture will improve the mobility and/or anti-ballistic properties of the vehicle. The drawings show various possible configurations for the replaceable add-on armor components.

FIG. 1 shows in phantom lines a tracked military tank having a hull 10, propulsion engine 11, turret 12, and main gun 14. Add-on ballistic units 16 are applied to external surfaces of the vehicle to increase its ability to withstand enemy attack. Anti-ballistic units 16 collectively constitute the aforementioned replaceable add-on armor kits. The armor units 16 at different areas of the vehicle need not all be the same material or areal density. For example, add-on armor at the underside of the hull can be designed to respond to the enemy mine threat, whereas frontal and side area armor can be designed to be responsive to armor-piercing or HEAT round threats. Upwardly-facing surface areas on the hull and turret can be equipped with add-on armor designed to defeat a variety of overhead threats, i.e. nuclear radiation, HE fragmentation and terminally guided submunitions. FIGS. 2 through 12 illustrate some methods for attaching add-on armor units 16 to the vehicle chassis (hull and turret). Preferably add-on armor units 16 are modularized or sized to an even fraction of the vehicle wall dimension in order to promote interchangeability of units.

Figure 2:
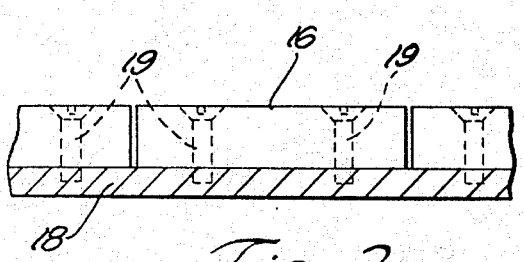
Figure 3:
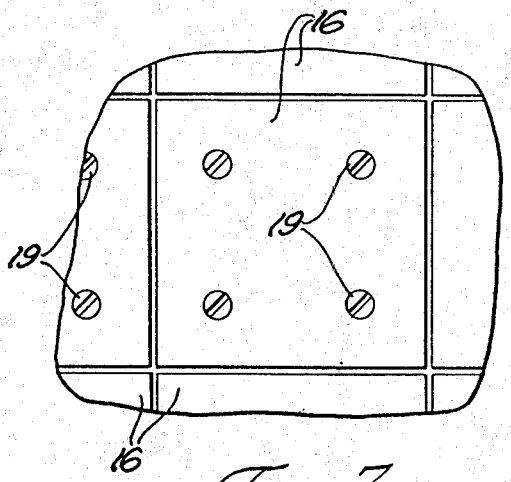

FIGS. 2 and 3 show an arrangement wherein a representative flat ballistic panel 16 is attached to the external surface of vehicle wall 18 by four bolts 19 threaded into blind holes in wall 18. Adjacent panels 16 have their edges abutted together to define a substantially uninterrupted outer surface. Should panels 16 not be used the holes in wall 18 can be plugged, as by threaded studs, not shown.

Figure 4:
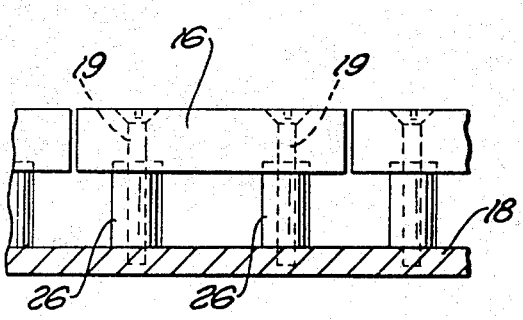

FIG. 4 illustrates an arrangement generally similar to FIG. 2 except that panels 16 are spaced from wall 18 by means of tubular spacers 26. This arrangement utilizes elongated attachment bolts 19 to achieve spaced armor protection against shaped charge projectiles.

Figure 5:
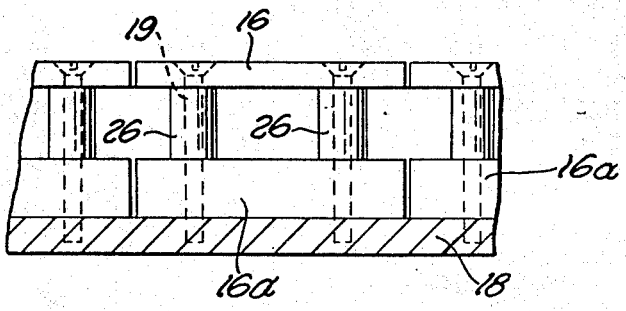

FIG. 5 is similar to FIG. 4 except that an additional armor panel **16*a* is incorporated into the system. The two armor panels 16 and 16*a*** provide protection against multiple types of warheads, e.g. shaped charge and armor-piercing.

Figure 6:
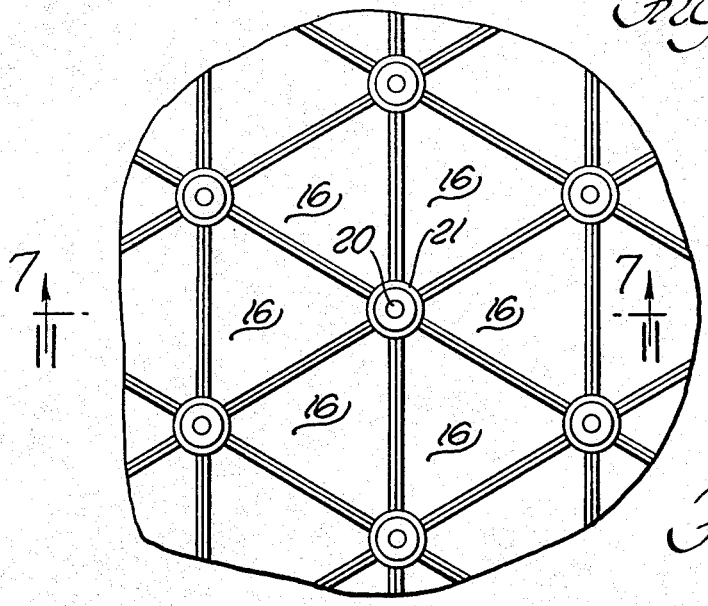
Figure 7:
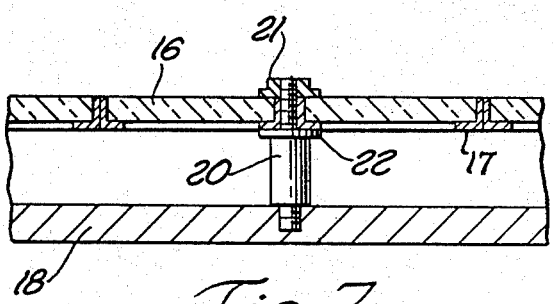
Figure 8:
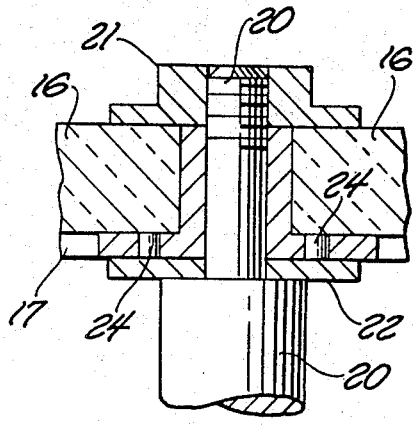

FIGS. 6, 7 and 8 show spaced armor add-on structure wherein individual armor panels 16 are seated in grid-like frames 17; in this case each panel and associated frame is triangular in plan dimension. The panel-frame units are retained in position spaced from vehicle wall 18 by means of tie rods 20 located at apex areas of the triangular panel-frame units. A nut 21 overlies a corner area of each panel 16 to retain same in the associated frame 17. A washer 22 is seated on rod 20 to underlie corner areas of six frames 17. Six pins 24 extend from washer 22 into circular holes in frames 17 to prevent frame dislodgement in the lateral direction. The arrangement of FIGS. 6, 7 and 8 provides for removal and replacement of individual armor panels 16 without removal of mounting rods 20.

Figure 9:
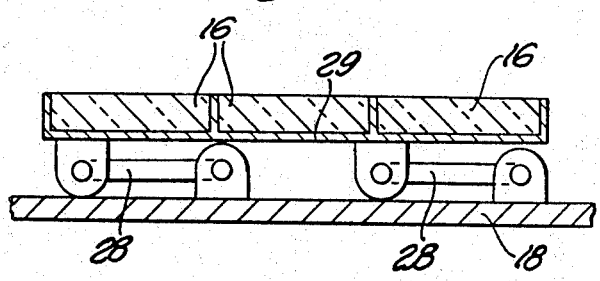
Figure 10:
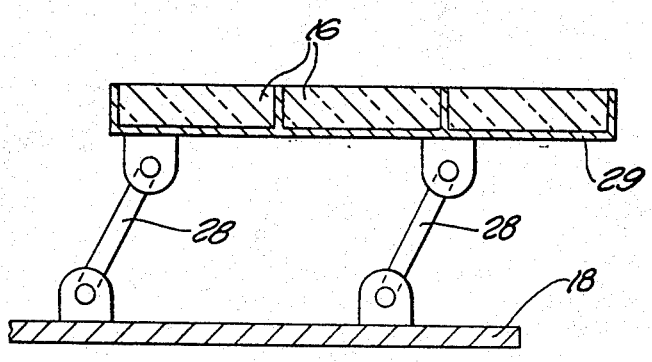

FIGS. 9 and 10 illustrate an adjustable add-on armor system designed so that the ballistic panels are selectively positioned close against the vehicle surface or spaced away from the vehicle surface to meet different enemy threats. The armor system includes a parallel linkage mechanism 28 arranged between vehicle wall 18 and the panel 16 grid support 29; lazy tong linkage could also be used. This arrangement is useful for varying the spacing between the vehicle outer surface and the ballistic panels, as necessary to defeat shaped charge attack or armor piercing projectile threat. This system can be employed on horizontal or vertical surfaces of the vehicle.

Figure 11:
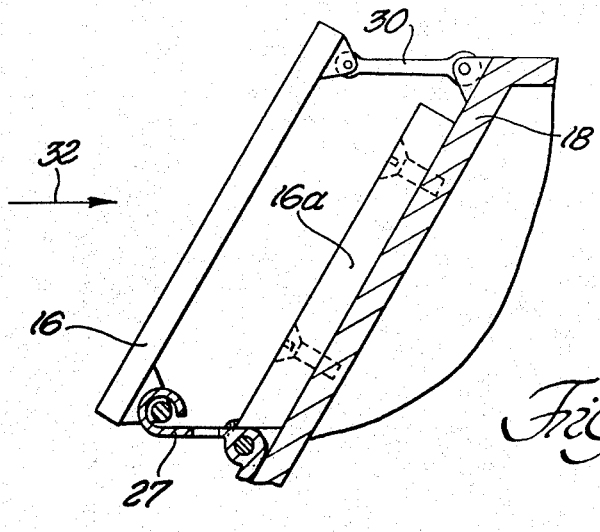

FIG. 11 illustrates add-on armor wherein armor panel 16 is hinged to a bracket 27 that is attached to the vehicle wall for supporting a second armor panel **16*a*. A spacer rod 30 supports the upper area of the outermost armor panel 16; enemy projectiles are assumed to be traveling in the arrow 32 direction. The FIG. 11** system is especially suited for use on vehicle turrets.

FIGS. 2 through 11 illustrate some representative add-on armor systems and methods of attachment to the military vehicle chassis. Other systems and methods of attachment not yet devised can be employed in practice of the invention. The attachment systems should preferably be vibration-resistant, durable, relatively simple and easily installable. Various types of clamps, mechanical support frameworks or grids, or weld connections are presently envisioned.

Our principal aim is to initially construct the vehicle with chassis areal density sufficient for structural integrity but not so great as to permanently define or limit the ballistic defense capability for the vehicle. Ballistic protection is defined primarily by the add-on armor panels 16 and **16*a*. Propulsion system 11 (FIG. 1) and the vehicle suspension system are each sized to take into account the bare vehicle weight plus the add-on armor weight. The panel 16 areal density would in most cases be appreciably greater than that of vehicle wall 18**, e.g. twice as great. Because a significant percentage of the vehicle weight is in the form of add-on armor it becomes feasible to replace a technologically obsolete armor panel system with a more technologically advanced system to produce a measurable change in the antiballistic performance of the existing vehicle.

The material for the vehicle hull and/or turret may be any conventional structural material, preferably a material having some antiballistic properties, as for example the material shown in U.S. Pat. No. 3,765,300 issued to K. M. Taylor et al on Oct. 16, 1973, or materials referenced in that patent disclosure. The materials for ballistic panels 16 can be selected in accordance with technology existing at the time of initial tank manufacture or at any later date when materials technology has advanced in response to enemy weapons threat development. Thus, panels 16 procured at the time of initial tank manufacture can at a later date be replaced with other panels or systems comprised of different ballistic materials, thereby providing different overall antiballistic performance.

Panels 16 can be selected for specific properties as for example the material shown in U.S. Pat. no. 3,324,768 specifically designed for defense against shaped charges. Other patents showing potentially useful armor plate materials are U.S. Pat. Nos. 3,431,818 to H. A. King; 3,179,553 to P. J. Franklin; 2,318,301 to E. Eger and 2,391,353 to H. W. Sheridan. Panels 16 can include or contain shielding materials for absorbing or reflecting harmful rays associated with nuclear explosions, as for example the materials shown in U.S. Pat. No. 2,928,948 to H. I. Silversher and U.S. Pat. No. 3,056,028 to J. T. Mattingly. Other materials and material combinations, not yet invented, can also be utilized.

The concept of add-on armor is broadly old, as for example shown in U.S. Pat. No. 2,380,393. However, in prior art systems known to us the add-on armor is used to up-armor a fully armored vehicle having propulsion-suspension systems initially sized without regard to the add-on armor. In such prior art systems, the presence of the permanent armor initially designed into the vehicle chassis makes it impossible to drastically alter the antiballistic capabilities of the vehicle without seriously impairing vehicle maneuverability or rough terrain ride capability. We propose a system wherein ballistic protection can be drastically altered after intial vehicle manufacture without significant sacrifice in maneuverability or rough terrain ride capability. A key element in our concept is to initially construct the vehicle chassis with a relatively low areal density, e.g. 40 pounds per square foot, sufficient only for structural integrity and minimum response to anti-personnel ballistic threat; major ballistic protection is provided by the add-on armor kits.

Another element in our concept is to include armor-attachment devices, e.g. threaded holes or brackets, on the original vehicle chassis. Incorporating the attachment devices into the original design avoids having to penetrate hardened armor to make connections for the add-on armor, as is the case in U.S. Pat. No. 2,380,393.

The process of drilling attachment holes in the hard armor surfaces of previously manufactured vehicles can be a relatively difficult and time-consuming operation. The presence of various obstructions and surface interruptions on conventional vehicles poses a further problem. However, by providing for the add-on armor at initial vehicle design it is possible to greatly minimize the difficulties.

We wish it to be understood that we do not desire to be limited to the exact details of construction shown and described for obvious modifications will occur to a person skilled in the art.

We claim:

1. A military combat vehicle comprising a chassis having an outer wall (18) defining the vehicle envelope, said chassis wall average areal density being sufficient for chassis structural integrity but insufficient for substantial anti-ballistic effect; a multiplicity of regularly-spaced blind holes formed in the outer surface of said chassis outer wall (18), the blind holes being internally threaded; a first set of add-on armor panels (16*a*) positionable flatwise directly on the outer surface of the chassis outer wall with no clearance space therebetween; a second set of add-on armor panels (16) positionable in outwardly spaced relationship to the first set of armor panels; panel-retention bolts (19) extending through the second armor panels and first armor panels into the aforementioned blind holes, and spacers (26) associated with the bolts in the spaces between the first armor panels and the second armor panels; a propulsion system (11) within the chassis; and a suspension system carried by the chassis for minimizing terrain shocks imposed on the chassis during vehicle movement; the propulsion system and suspension system being sized and designed to operate with the add-on armor panels in place on the vehicle; the above-described hole-bolt type connection mechanisms permitting replacement of the add-on panels with different add-on armor systems devised after initial manufacture of the vehicle; the areal density of said first and second add-on armor panels being appreciably greater than the chassis wall areal density, whereby panel replacement procedures can be employed to drastically alter the anti-ballistic characteristics of the vehicle.

2. The military vehicle of claim 1: the average areal density of the first and second add-on armor panels being collectively at least twice the average areal density of the chassis outer wall.

* * * * *